US012083576B2

(12) United States Patent
Grumm et al.

(10) Patent No.: US 12,083,576 B2
(45) Date of Patent: Sep. 10, 2024

(54) POWER TOOL POWERED CAN SEAMER

(71) Applicant: Oktober, LLC, Grand Rapids, MI (US)

(72) Inventors: Dennis Grumm, Grand Rapids, MI (US); Svend Sorensen, Grand Rapids, MI (US)

(73) Assignee: OKTOBER, LLC, Grand Rapids, MI (US)

( * ) Notice: Subject to any disclaimer, the term of this patent is extended or adjusted under 35 U.S.C. 154(b) by 43 days.

(21) Appl. No.: 17/962,414

(22) Filed: Oct. 7, 2022

(65) Prior Publication Data

US 2023/0111651 A1 Apr. 13, 2023

Related U.S. Application Data

(60) Provisional application No. 63/253,508, filed on Oct. 7, 2021.

(51) Int. Cl.
*B21D 51/30* (2006.01)

(52) U.S. Cl.
CPC ..... *B21D 51/30* (2013.01)

(58) Field of Classification Search
CPC ..... B21D 51/30; B21D 51/32; B21D 51/34
See application file for complete search history.

(56) References Cited

U.S. PATENT DOCUMENTS

2017/0312803 A1* 11/2017 Grumm ..... B21D 51/2653

* cited by examiner

*Primary Examiner* — Debra M Sullivan
(74) *Attorney, Agent, or Firm* — The Watson IP Group, PLC; Jovan N. Jovanovic

(57) ABSTRACT

A can seaming apparatus comprising a frame, a can handling assembly and a can seaming assembly. The frame has a bottom end and a top end, an upper mounting plate and a lower mounting member. The can handling assembly has an upper chuck and a lower chuck, the upper and lower chucks configured to releasably retain a can and top therebetween. The can seaming assembly includes a roller frame with a first and second roller, wherein the first and second rollers are directable into contact with the can and top while being retained by the upper and lower chucks. The upper chuck is fixed to an axle that extends through the upper mounting plate, and is rotatably coupled to the upper mounting plate. The axle extends beyond the upper mounting plate and structurally configured to be free from obstruction sufficient to allow a for the operable attachment of a chuck of a power tool. A combination can seaming apparatus and power tool is likewise disclosed, as are methods of operation.

19 Claims, 10 Drawing Sheets

POWER TOOL POWERED CAN SEAMER

CROSS-REFERENCE TO RELATED APPLICATION

This application claims priority from U.S. Patent App. No. 63/253,508 entitled "Power Tool-Powered Can Seamer", filed Oct. 7, 2021, the entire disclosure of which is hereby incorporated by reference in its entirety.

This application is related to, but does not claim priority from, U.S. Pat. App. Ser. No. 62/330,072 filed Apr. 30, 2016, entitled "Can Seaming Apparatus", U.S. patent application Ser. No. 15/581,190, filed Apr. 28, 2017, entitled "Can Seaming Apparatus", and U.S. patent application Ser. No. 16/156,742, filed Oct. 10, 2018, entitled "Can Seaming Apparatus", the entire disclosures of each of which are hereby incorporated by reference in their entireties.

BACKGROUND OF THE DISCLOSURE

1. Field of the Disclosure

The disclosure relates in general to a container forming apparatus, and more particularly, to a can seaming apparatus that is configured to form the double seam can seal on a can via a power tool, such as a power drill. While not limited thereto, the apparatus is well suited for the application of a double seam can seal on a typical aluminum beverage can (such as what is known as a beer can). Of course, this is to be deemed exemplary and is not to be deemed limiting.

2. Background Art

The manufacture of cans is known in the art. For example, beverage cans are formed from a lower can portion and an upper can top. With a typical can configuration, the can includes an upper outward flange. The cover includes a cover curl that extends over the end of the flange and below the flange. In a first operation, a roller directs the cover between the flange and the body to form an initial crimp. Next, in a second operation, a second roller flattens the seam to complete the double seam can seal.

While equipment for coupling the upper can top to the can is known, current equipment has many drawbacks. First, much of the available equipment comprises larger equipment that is configured to continuously, and in an automated fashion, seal successive cans. Such equipment is not suitable or efficient for smaller batch production. Moreover, for small batch production, such equipment is too costly to purchase and operate.

Other solutions exist that are more well suited to smaller batch production. Nevertheless, such equipment also has drawbacks. In particular, some such equipment requires extensive training, and may be difficult to operate. Other such equipment, while suitable for smaller batch production, is nevertheless expensive to purchase and operate.

There remains a need for a small, efficient and cost effective can seaming apparatus.

SUMMARY OF THE DISCLOSURE

The disclosure is directed, in one aspect to a can seaming apparatus comprising a frame, a can handling assembly and a can seaming assembly. The frame has a bottom end and a top end. An upper mounting plate is attached to the frame proximate the top end of the frame. A lower mounting member attached to the frame proximate the bottom end of the frame The can handling assembly includes an upper chuck and a lower chuck. The upper chuck is fixed to an axle that extends through the upper mounting plate, and is rotatably coupled to the upper mounting plate, the axle extending beyond the upper mounting plate and structurally configured to be free from obstruction sufficient to allow a for the operable attachment of a chuck of a power tool. The lower chuck has an axle extending therefrom. The axle is slidably mountable to the lower mounting member, with an overcenter mechanism including a handle that is movable relative to the frame to direct the lower chuck between a lower position and an upper position. In the upper position, the lower chuck is directed into position relative to the upper chuck so as to releasably retain a can therebetween. The can seaming assembly has a roller frame pivotably coupled to the upper mounting plate. The roller frame has a first roller and a second roller rotatably mounted to the roller frame. A handle extends outwardly from the roller frame so as to structurally facilitate the pivoting of the roller frame about the upper mounting plate so as to direct one of the rollers toward the upper chuck while directing the other of the rollers away from the upper chuck.

In some configurations, the can seaming apparatus further comprises a power tool having a body, an actuator and a chuck. The chuck is attached to the axle extending through the upper mounting plate, whereupon rotation of the chuck rotates the axle.

In some configurations, a power tool mount is coupled to the frame. The power tool mount having a fork defining a slot, with the body of the power tool being releasably positionable within the slot when the chuck is attached to the axle.

In some configurations, the actuator of the power tool is positioned to a first side of the frame with the handle of the can seaming assembly being positioned on a second side of the frame opposite the first side of the frame, to allow for a user to operate each with one hand.

In some configurations, the frame comprises a tower portion and a base portion. The tower portion has a back wall, a first side wall on one side of the back wall, a second side wall a side of the back wall opposite the first side wall, a first side wing extending between the back wall and the first side wall, and being oblique to each, and a second side wing extending between the back wall and the second side wall, and being oblique to each. The base portion has a central region, a first side wall on one side of the central region and a second side wall on a side of the central region opposite the first side wall. The first side wall includes a front flange that is insertable through a lower slot of the first side wing of the tower portion. The second side wall includes a front flange that is insertable through a lower slot of the second side wing of the tower portion.

In some configurations, the central region of the base portion is perpendicular to the back wall of the tower portion.

In some configurations, the can seaming apparatus has a shield assembly including a shield, a shield frame, a shield handle, a first side linkage, and a second side linkage. The shield has a first side edge, a second side edge, a lower edge and an upper edge, the shield configured so as to extend between the first side wall and the second side wall. The shield frame bracket having a first side flange proximate the first side edge and a second side flange proximate the second side edge. The shield handle extends from a front of the shield. The first side linkage has a first end pivotably coupled to the first side wall and a second end pivotably coupled to the first side flange. The second side linkage has a first end pivotably coupled to the second side wall and a second end pivotably coupled to the second side flange. The handle of the overcenter mechanism is attached to at least one of the handle and the shield proximate the lower edge of the shield. The pivoting of the shield by the handle relative to the first side linkage and the second side linkage moves the lower chuck between a lower position and an upper position.

In some configurations, the first side wall includes a notch along a front edge thereof and the second side wall includes a notch along a front edge thereof. The first side flange of the shield frame bracket corresponds to the notch of the first side wall when the lower chuck is in the upper position. The second side flange of the shield frame bracket corresponds to the notch of the second side wall when the lower chuck is in the upper position.

In some configurations, the first side wall of the tower portion includes a first foot, the second side wall includes a second foot, the first side wall of the base portion includes a third foot, and the second side wall of the base portion includes a fourth foot. The first, second, third and fourth foot forming a stable base upon which the can seaming apparatus is placeable on an outside surface.

In some configurations, the tower portion is formed from a single planar sheet. The base portion is formed from a single planar sheet.

In some configurations, an upper cover member positioned over the upper mounting plate, with the axle extending through the upper cover member.

In another aspect of the disclosure, the disclosure is directed to a combination can seaming apparatus and power tool. The can seaming apparatus further comprises a frame, a can handling assembly and a can seaming assembly. The frame has a bottom end and a top end. An upper mounting plate attached to the frame proximate the top end of the frame. A lower mounting member is attached to the frame proximate the bottom end of the frame. The can handling assembly includes an upper chuck and a lower chuck. The upper chuck is fixed to an axle that extends through the upper mounting plate, and is rotatably coupled to the upper mounting plate. The axle extending beyond the upper mounting plate and structurally configured to be free from obstruction sufficient to allow a for the operable attachment of a chuck of the power tool. The lower chuck has an axle extending therefrom. The axle is slidably mountable to the lower mounting member, movable toward and away from the upper chuck. The can seaming assembly has a first roller and a second roller rotatably mounted to at least one roller frame. The at least one roller frame is configured to pivot about the frame so as to selectively direct the first roller and the second roller toward the upper chuck and away from the upper chuck. The power tool includes a body, an actuator and a chuck, the chuck releasably coupled to the axle.

In some configurations, the frame further includes a power tool mount extending from the frame, with the power tool being releasably mountable to the power tool mount.

In yet another aspect of the disclosure, the disclosure is directed to a method of sealing a can comprising the steps of: providing a can seaming apparatus; providing a power tool, the power tool including a body, an actuator and a chuck; attaching the chuck to the axle; retaining a can with a top between the upper chuck and the lower chuck; actuating the drill; engaging the can with the top by the first roller; and engaging the can with the top by a second roller.

In some configurations, the method of sealing a can further comprising the step of placing a shield assembly over the can with top during the steps of actuating the drill, engaging the can with the top by the first roller and engaging the can with the top by a second roller.

BRIEF DESCRIPTION OF THE DRAWINGS

The disclosure will now be described with reference to the drawings wherein.

DETAILED DESCRIPTION OF THE DISCLOSURE

Figure 1:
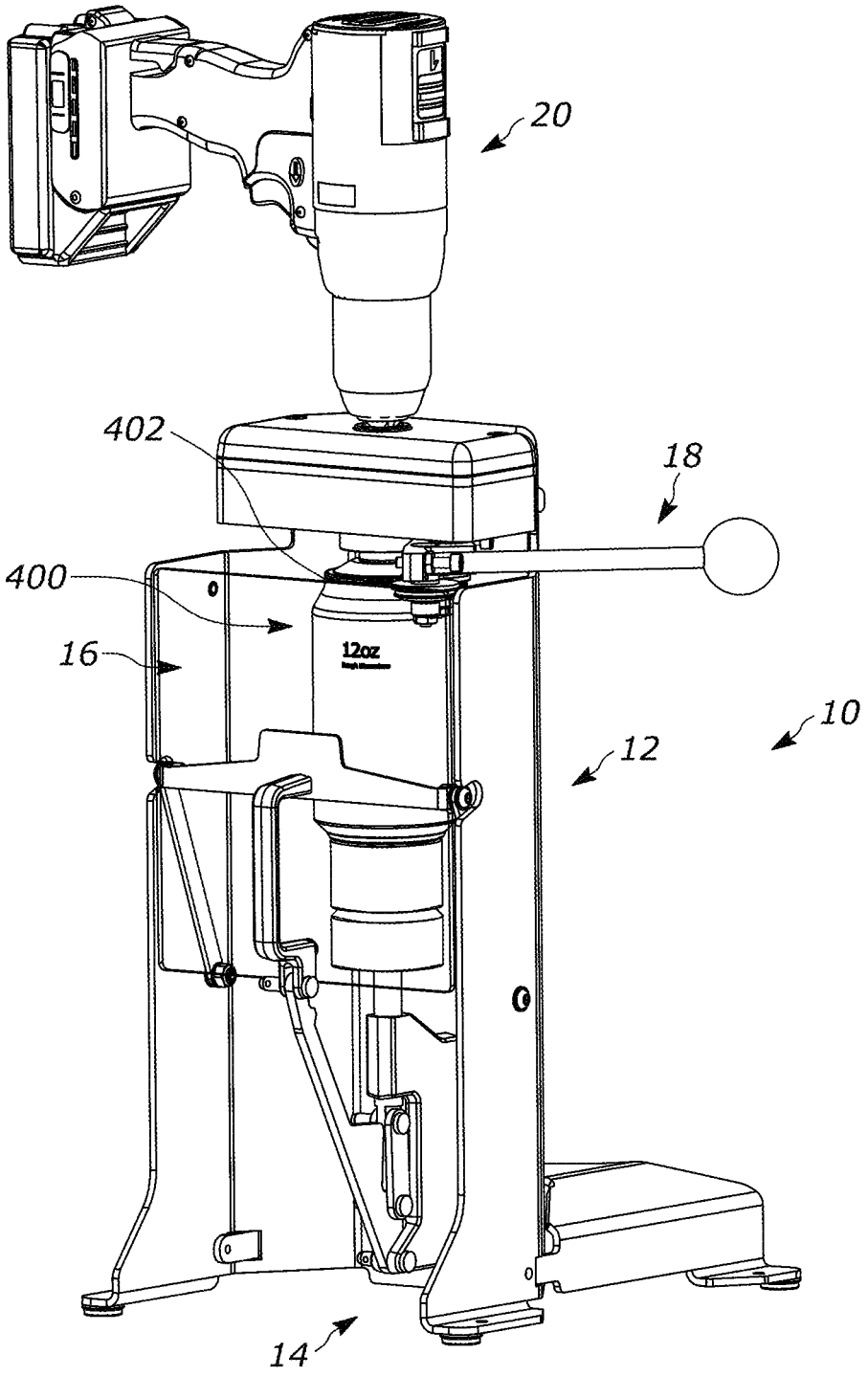
FIG. 1 illustrates a front, side perspective view of a can seaming apparatus in accordance with the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
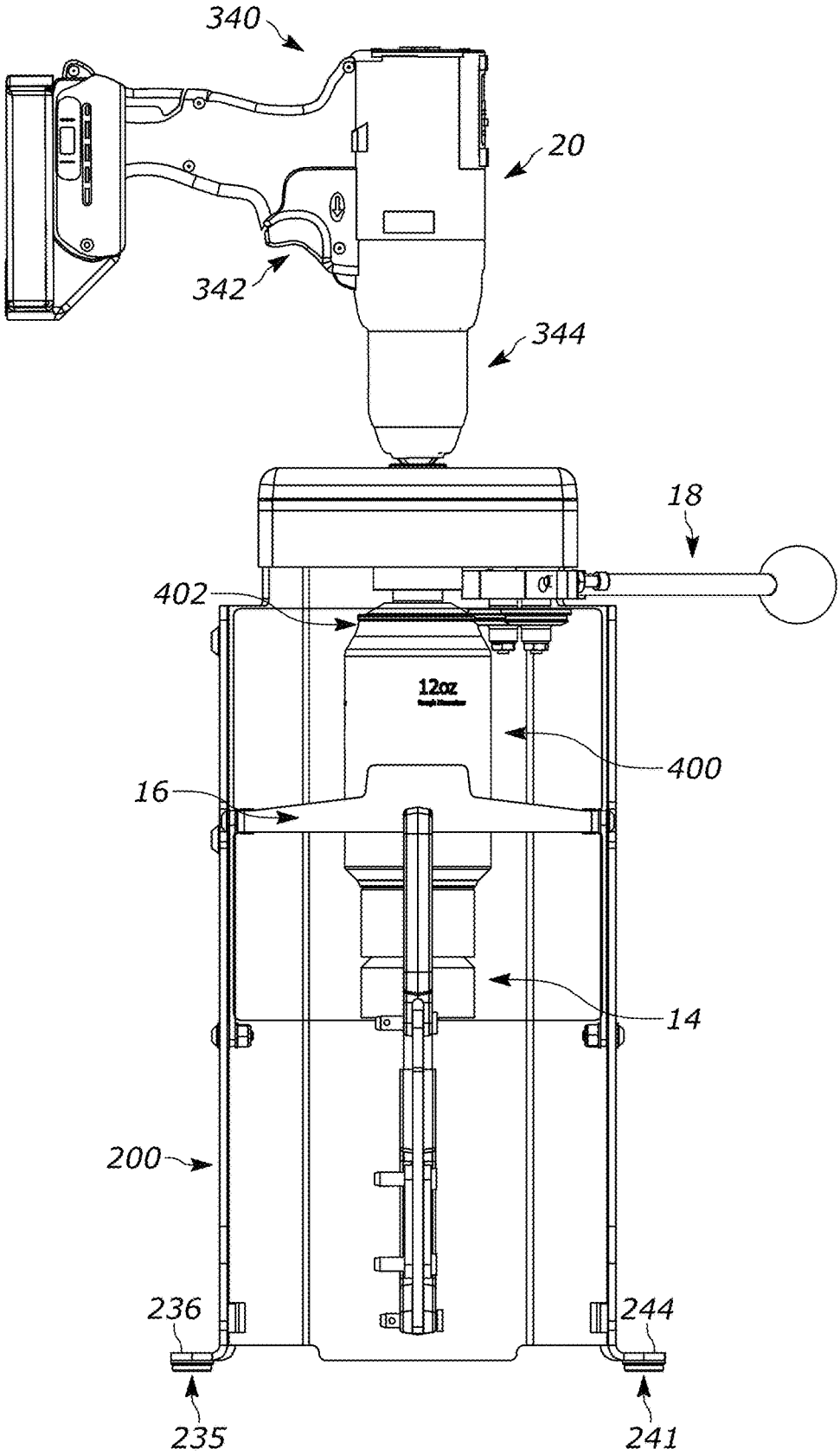
FIG. 2 illustrates a front elevational view of the can seaming apparatus of the present disclosure.
Figure 3:
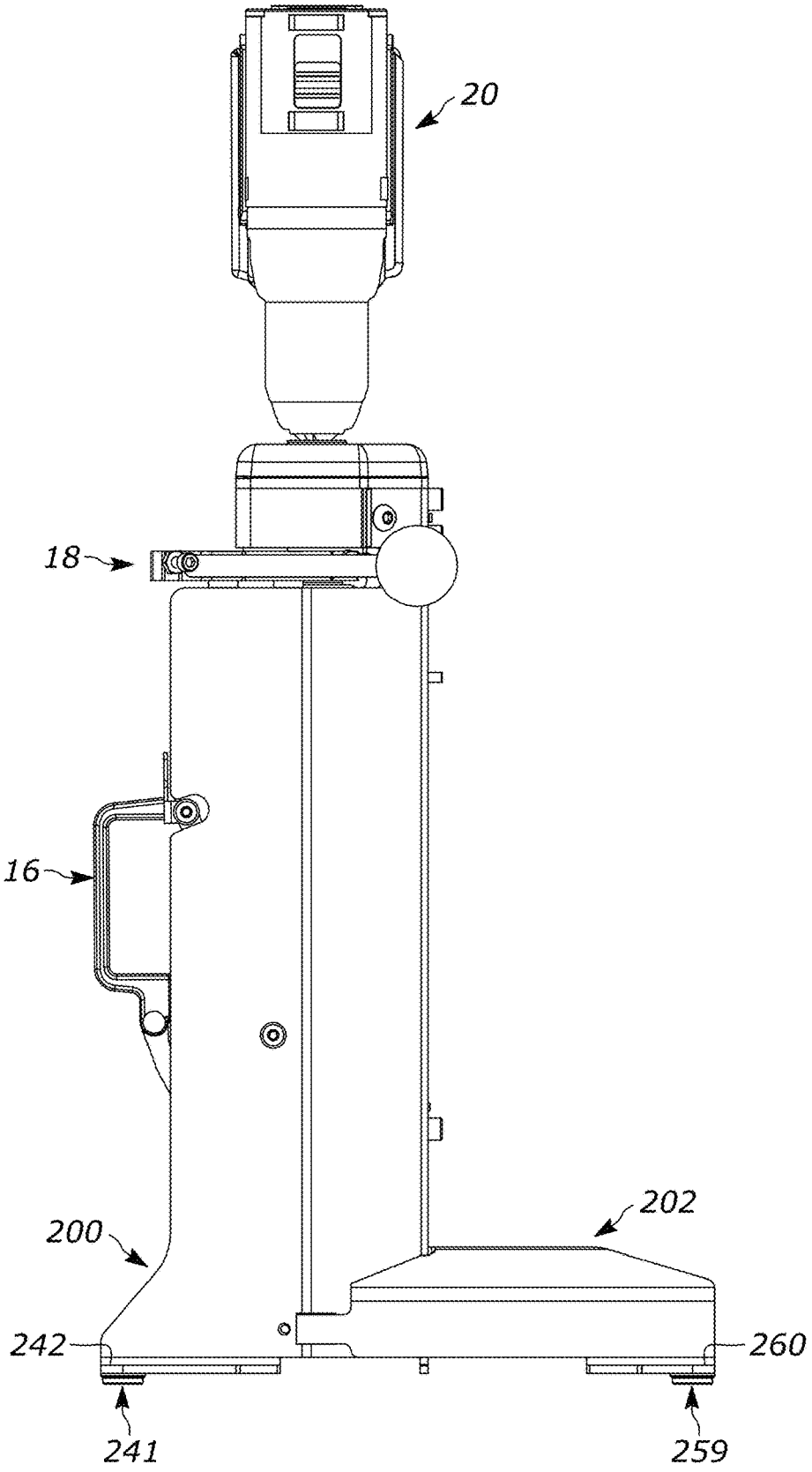
FIG. 3 illustrates a side elevational view of the can seaming apparatus of the present disclosure.
Figure 10:
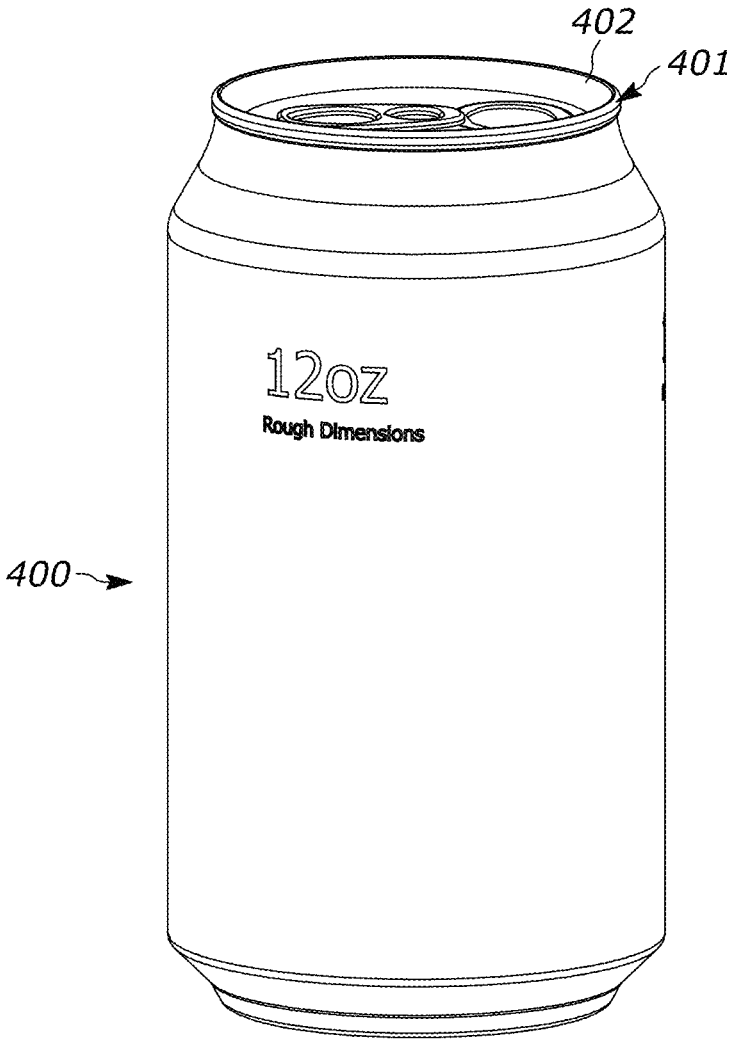
FIG. 10 illustrates a perspective view of an example can blank having a cap thereon, in accordance with at least one configuration disclosed herein.

Referring now to the drawings and in particular to FIGS. 1 through 3, a can seaming apparatus is shown generally at 10. The can seaming apparatus 10 includes frame 12, can handling assembly 14, shield assembly 16, seam forming assembly 18, and power tool 20. The can seaming apparatus 10 is configured to be manually operated, preferably by a single user manipulating the power tool 20 with one hand and the seam forming assembly 18 with the other. Such a configuration allows for the inexpensive and efficient self-canning and sealing of cans, such as can 400 shown in detail FIG. 10, by an individual with the utilization of a commonly available power tool. Advantageously, the power tool 20 can be attached directly to the axle 92 of the can handling assembly 14 without requiring any additional components, gears, pulleys, drive trains, gear trains, belts, or the like. This can greatly simplify the seam sealing assembly so as to allow for the individual user to achieve canning with greater simplicity and within the home.

Figure 4:
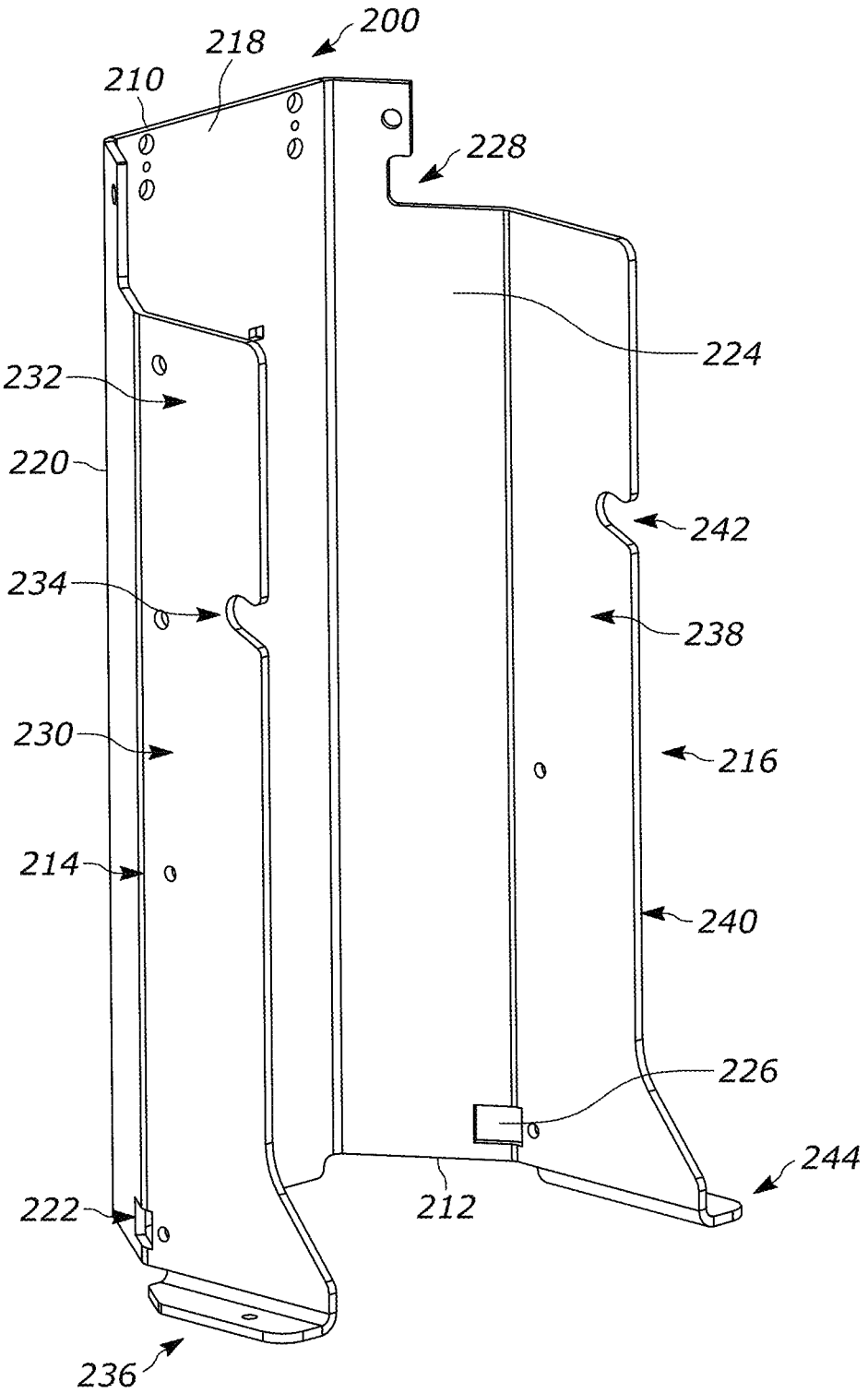
FIG. 4 illustrates a perspective view of the tower portion of the frame of the can seaming apparatus of the present disclosure.
Figure 5:
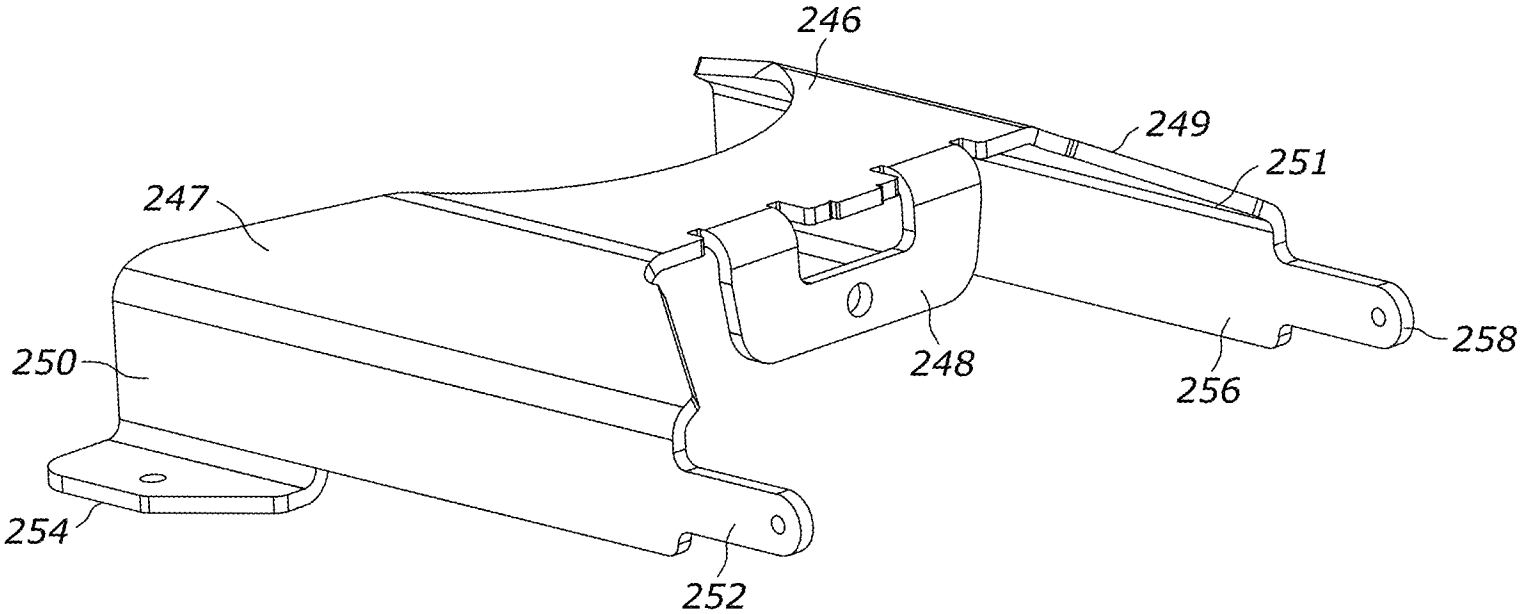
FIG. 5 illustrates a perspective view of the base portion of the frame of the can seaming apparatus of the present disclosure.

In the configuration shown in FIGS. 4 and 5, in addition to FIGS. 1 through 3, the frame 12 is shown as comprising tower portion 200, base portion 202, upper mounting plate 204, upper cover member 206 and lower mounting member 208. The tower portion includes top end 210, bottom end 212, first side 214 and second side 216. The tower portion is defined by back wall 218, first side wing 220, second side wing 224, first side wall 230 and second side wall 238. The back wall 218 is generally perpendicular to the first side wall 230 and the second side wall 238, with the first side wing 220 being oblique to each of the back wall and the first side wall, and with the second side wing 224 being oblique to each of the back wall and the second side wall. In the configuration shown, the tower portion is formed from a single piece of, for example, sheet metal that has been formed into the desired configuration. Of course, other materials are contemplated, as are other configurations (including the configuration shown in the priority application incorporated herein in its entirety). The back wall may further include a can forming bracket (not shown) 27 which aids in the proper placement of the can 400.

The first side wing 220 includes lower slot 222 which is positioned proximate the interface between the first side wing 220 and the back wall 218. The second side wing 224 includes lower slot 226 which is positioned proximate the interface between the second side wing and the second side wall 238. The second side wing 224 further includes upper groove 228 (which is configured to receive the rotation actuator handle 104 of the seaming assembly 18).

The first side wall 230 includes front edge 240 and foot 236. The first side wall 230 extends from the first side wing, and terminates at the front edge 232. A notch 234 is defined in the front edge, which is configured to receive portions of the shield bracket frame (and fasteners associated therewith). The foot 236 comprises an outward flange at the lower end of the first side wall 230. A resilient member 235 (such as a rubber or polymer member) may be disposed on the lower end of the outward flange for contact of the foot with an outside surface.

The second side wall 256 includes front edge 258 and foot 260. The second side wall 238 extends from the second side wing 224, and terminates at the front edge 258. A notch 242 is defined in the front edge, which is configured to receive portions of the shield bracket frame (and fasteners associated therewith). The foot 260 comprises an outward flange at the lower end of the second side wall 256. A resilient member 241 (such as a rubber or polymer member) may be disposed on the lower end of the outward flange for contact of the foot with an outside surface.

The back wall, the first and second side wings and the first and second side walls together define a sealing cavity (which is then selectively enclosed by the shield assembly).

The base portion 202 comprises a central region 246, a first side wall 250 and a second side wall 256. The central region 246 includes a central flange 248 which depends from the central region 246. Additionally, the central region 246 includes a first oblique wing 247 and a second oblique wing 249 extending obliquely to the central region 246 on either side thereof. The central region and the first oblique wing and the second oblique wing together define an inner perimeter 251, which generally follows the outer contours of the back wall 218, the first side wing 220 and the second side wing 224.

The first side wall 250 depends from the first oblique wing 247 and is generally perpendicular to the central region 246. At a forward end of the first side wall, a front flange 252 is defined. Further, at a lower edge thereof, a foot 254 is formed. A resilient member 255 may be disposed on the lower end of the foot 254 for contact of the foot with an outside surface. The second side wall 256 depends from the second oblique wing 249 and is generally perpendicular to the central region 246 and generally parallel to the first side wall 250. At a forward end of the second side wall, a front flange 258 is defined. Further, at a lower edge thereof, a foot 260 is formed. A resilient member 259 may be disposed at the lower end of the foot 260.

The base portion 202 is coupled to the tower portion 200 to provide a solid configuration upon which to form the remainder of the can seaming apparatus 10. In particular, the base portion 202 is abutted against the back of the tower portion with the central flange 248 abutting the back of the back wall 218, with the inner perimeter 251 following the back wall and the first and second side wings. The front flange 252 of the first side wall 250 extends through the lower slot 222 of the first side wing 220. The front flange 258 of the second side wall 256 extends through the lower slot 226 of the second side wing 224. Fasteners are utilized to couple the two structures together.

When assembled, the foot of each of the first and second side walls of the tower portion and the foot of each of the first and second side walls of the base portion together define a platform upon which the can seaming apparatus can be placed on an outside surface. In the configuration shown, the central region of the base portion and the back wall of the tower portion are perpendicular to each other. And, the first and second side walls of the tower portion are generally parallel with the first and second side wall of the base portion.

Figure 7:
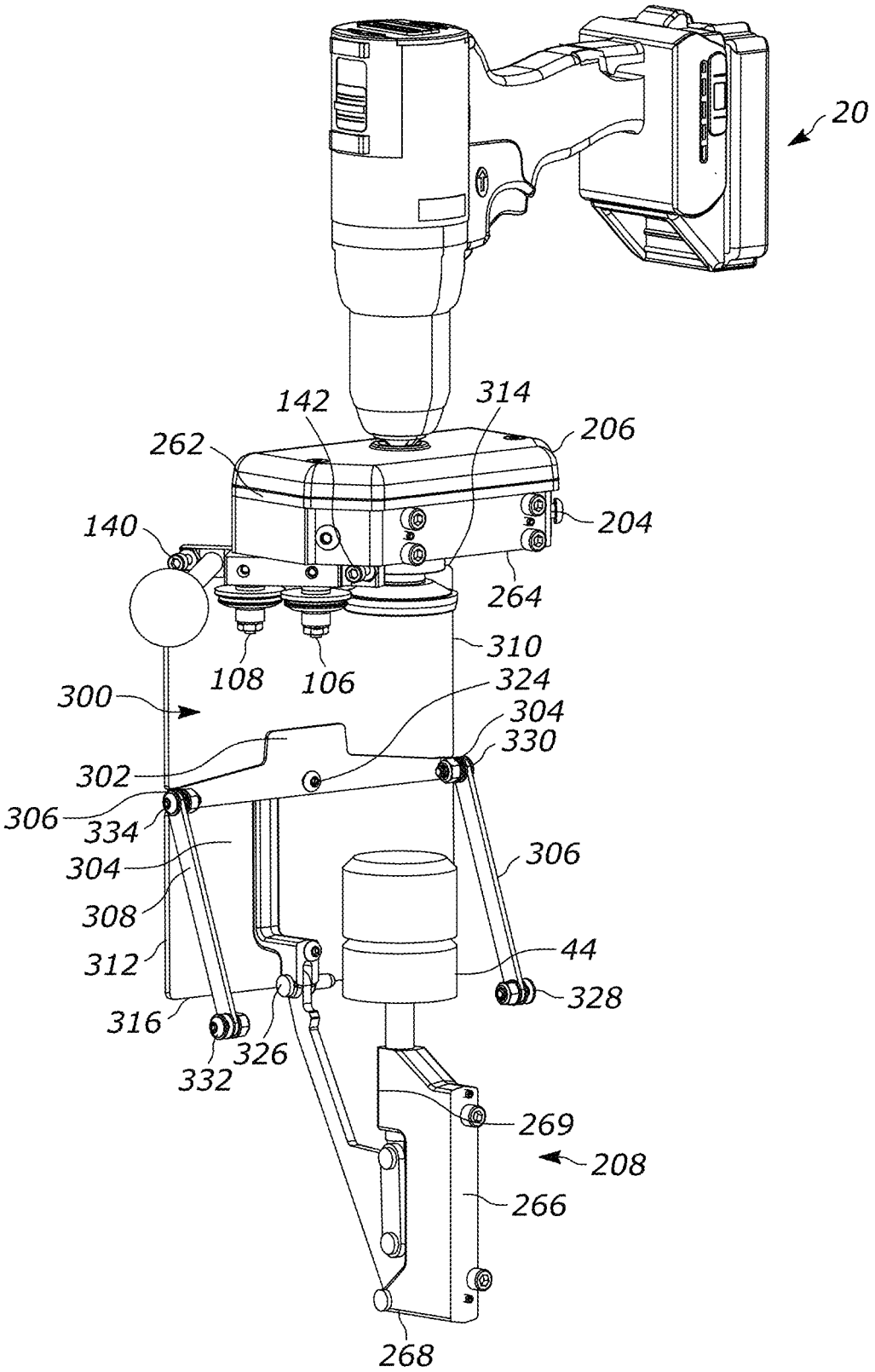
FIG. 7 illustrates a back perspective view of some of the components of the can seaming apparatus of the present disclosure.
Figure 8:
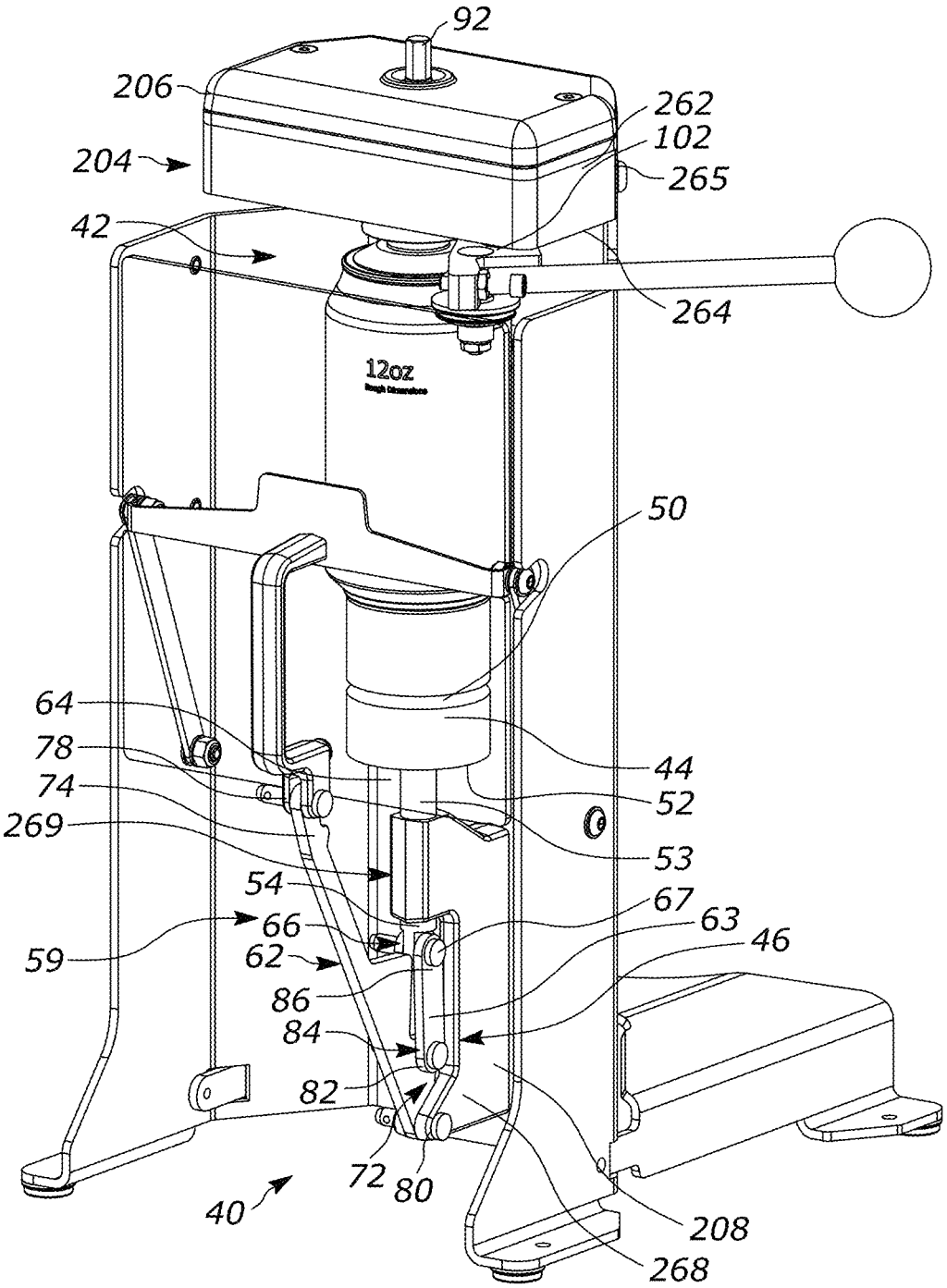
FIG. 8 illustrates a perspective view of the can seaming apparatus of the present disclosure, without the power tool coupled thereto, and with the axle visible.

With further reference to FIGS. 7 and 8, the upper mounting plate 204 comprises a block that includes a top surface 262, a bottom surface 264 and an inner edge 265. The upper mounting plate 204 is configured to receive the upper can handling subassembly 42 of the can handling assembly 14 and the seaming assembly 18. The upper mounting plate 204 is fastened to the upper end of the tower portion of the frame, and generally follows the contours of the tower portion. An upper cover member 206 may be disposed on the top surface 262 of the upper mounting plate, so as to provide a finished surface for handling and for interfacing of the drill.

A lower mounting member 208 is coupled to the tower portion at a lower end thereof. The lower mounting member 208 includes a back wall 266 which abuts the backwall of the tower portion 200. Opposite the back wall 266 is a lower slot 268 and an upper bore 269. These structures are configured to interface with the lower can positioning subassembly 46 of the can handling assembly 14.

Figure 6:
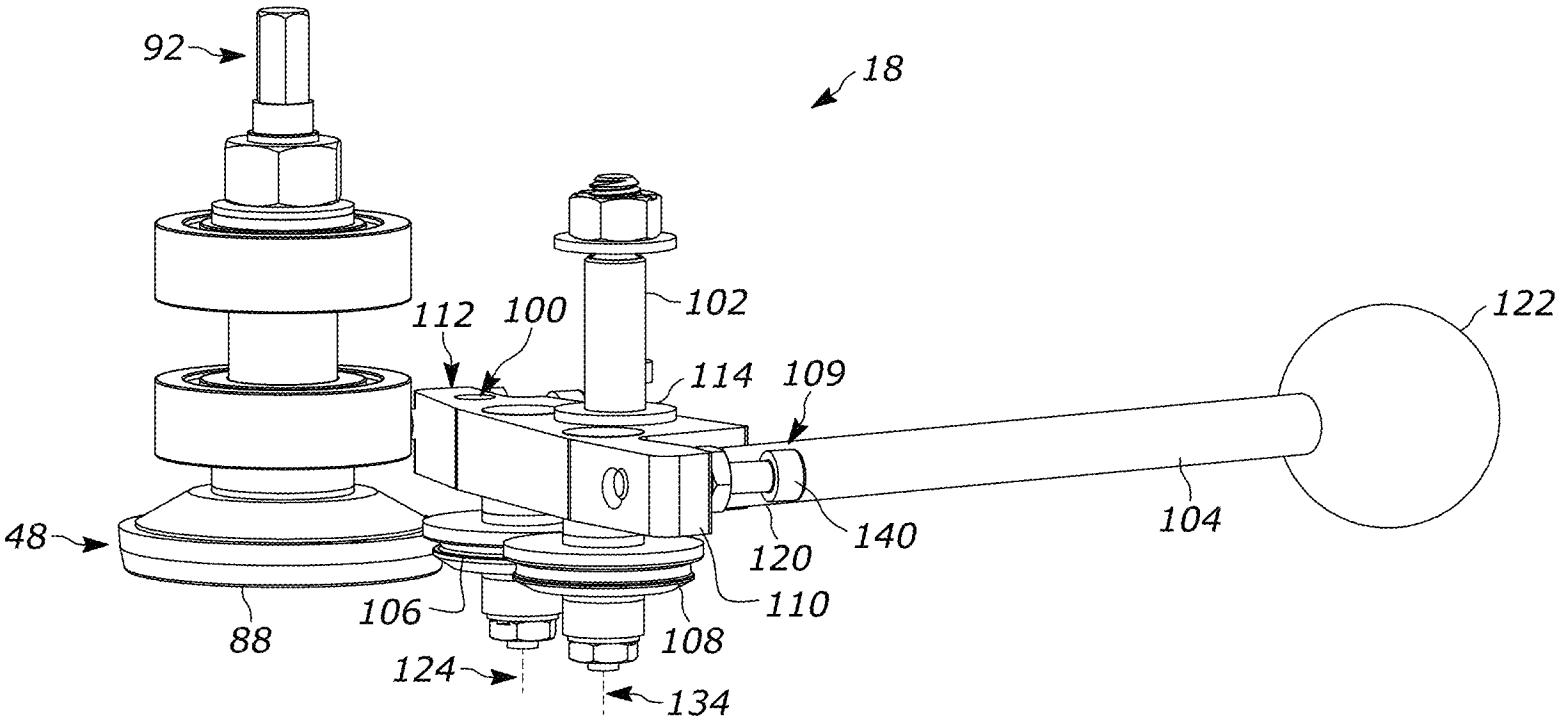
FIG. 6 illustrates a perspective view of the upper chuck components, the axle and the can seaming assembly of the can seaming apparatus of the present disclosure.

With reference to FIGS. 6 through 8, the can handling assembly 14 is shown as including lower end can handling subassembly 40 and upper end can handling subassembly 42. The lower end can handling subassembly 40 includes lower chuck 44 and lower can positioning subassembly 46. Lower chuck 44 includes upper surface 50 and lower axle opening 52. The axle opening 52 defines axis of rotation 53 of the lower chuck. The upper surface of the lower chuck 44 is configured to matingly engage the lower surface of the can 400, such as can 400 of FIG. 10. The can generally comprises a conventional, typically aluminum, can blank that has an outer lower rim with a generally outwardly concave, or domed configuration. The upper surface of the lower chuck 44 is configured to engage with the outer lower rim and concave configuration so that the can 400 positioned thereon rotates about its central axis which matches the central axis of the lower chuck 44. In the configuration shown, the can 400 is merely placed on the lower chuck 44, and the lower chuck 44 does not include gripping means or the like (although some type of gripping means are contemplated). In some configurations, one or more spacer members, such as spacer member 51, may be provided to accommodate different types of cans (i.e., generally standard cans of different heights, or diameters).

In more detail, the upper surface 50 includes an outer chamfer which facilitates the centering of the can 400 when positioned thereon. The chamfer can engage or direct/urge/push the can 400 into the proper orientation on the lower chuck 44. The lower chuck 44 may further include a biasing member (not shown) (which may comprise an internally mounted a spring washer or wave spring) that biases the upper surface 50 toward an upper chuck 48. This allows for some biasing force when clamped through the overcenter mechanism 59.

The lower can positioning subassembly 46 includes upper push rod 54, overcenter handle 62 and linkage assembly 63. The lower can positioning subassembly 46, in the configuration shown, defines the overcenter mechanism 59 which can slidably direct the lower chuck 44 upwardly and downwardly between a lower position wherein the lower chuck is spaced furthest from the upper chuck and an upper position wherein the chuck is spaced toward the upper chuck, and, the overcenter mechanism is configured to lock the lower chuck in the upper position. As will be explained below, such movement can lock, in a clamping manner, the can 400 between the upper and lower chucks 48, 44.

The upper push rod 54 includes first end 64 and second end 66, and extends through the upper bore 269 of the lower mounting member 208. The first end 64 is coupled to the lower axle opening 52 of the lower chuck 44 and together with the upper bore 269 defines the axis of rotation of the lower chuck 44. The second end 66 includes axle 67 (or opening 67 configured to receive an axle so as to define an axis of rotation or pivotable coupling).

The overcenter handle 62 includes arm 72 and lever portion coupling 74. The lever portion coupling 74 includes lower pivot connection 80 and upper pivot connection 82. The two pivot connections are spaced apart from each other. The arm 72 extends outwardly therefrom and includes first end 77 that is proximate the two pivot connections 84, 86 and second end 78 which is spaced apart therefrom. The arm 72 provides the leverage necessary to rotate the arm 72 relative to the linkage 63 and the lower slot 268 of the lower mounting member 208, as will be explained. The linkage 63 includes first pivot connection 84 and second pivot connection 86. The first pivot connection is pivotably coupled to the axle 67 of the second end of the upper push rod 54. The second pivot connection is coupled to the upper pivot connection 82 of the handle 62.

The overcenter mechanism 59 is formed by coupling the lower pivot connection 80 of the lower portion coupling 74 of the overcenter handle 62 to the lower slot 268 of the lower mounting member 208. As the overcenter handle 62 is rotated about the lower slot 268, the upper push rod 54 is directed in an upward direction relative to the lower mounting member 208. At some point the overcenter handle 62 member reaches a point at which further rotation is not permitted, at which time, the overcenter handle 62 can be locked in such apposition (assuming that there is an opposite force on the lower chuck 44—which would be caused by the can 400 being sandwiched, or clamped, between the upper and lower chucks 44, 48). The overcenter handle 62, as will be explained below, can be rotated in the opposite direction, to direct the lower chuck 44 back down, toward the lower mounting member 208.

With reference to FIG. 6, in addition to FIGS. 1 and 2, the upper end can handling subassembly 42 includes the upper chuck 48 which includes lower surface 88 and an axle 92 fixed to the upper chuck. The lower surface 88 is configured to matingly engage the upper cap 402 of the can 400 which is resting on an upper outwardly directed flange of the can 400. The upper chuck 48 is configured to releasably maintain the upper cap in the desired orientation and to allow for the rotation of the can 400 about its central axis. The axle 92 extends from the upper chuck 48 and through a corresponding bore of the upper mounting plate 204. It will be understood that the axle 92 is permitted to rotate within the corresponding bore of the upper mounting plate, while generally precluded from translating within the bore once it is coupled thereto. As will be explained below, the axle 92 extends sufficiently beyond the mounting plate and the upper cover member so that it is structurally configured to be free from obstruction sufficient to allow a for the operable attachment of a chuck of a drill. That is, there is sufficient extension so as to capture the end within the chuck of a power tool, preferably, with a structure to improve the grip thereof, and preferably without first removing other structures which may provide power thereto.

Shield assembly 16 is shown in FIG. 7 along with FIGS. 1 and 2, as comprising shield 300, shield frame bracket 302, shield handle 304, first side linkage 306 and second side linkage 308. The shield 300 comprises, in the configuration shown, a generally planar transparent polymer sheet such as, for example, a polycarbonate or plexiglass. The shield 300 includes first side edge 310, second side edge 312, upper edge 314 and lower edge 316. The shield 300 is sized so as to extend from first side wall 230 to second side wall 238 and so that the side walls generally meet the side edges of the shield. The upper edge 314 and lower edge 316, collectively define the height of the shield, and the height is configured to extend between and cover the upper chuck and the lower chuck, generally when the lower chuck is in the upper position.

The shield frame bracket 302 includes first side flange 320 and second side flange 322. The first side flange 320 extends around the first side edge of the shield 300. The second side flange 322 extends around the second side edge of the shield 300. The shield handle is coupled at a upper coupling to the shield frame bracket 302, and at a lower coupling to a lower end of the shield 300. Additionally, the lower end of the handle is pivotably coupled to the second end 78 of the lever handle.

The first side linkage 306 is pivotably coupled at a first end 328 to the first side flange 320 of the shield frame bracket 302 and at a second end 330 to the first side wall 230 of the frame 12. The second side linkage 308 is pivotably coupled at a first end 332 to the second side flange 322 of the shield frame bracket 302 and at a second end 334 to the second side wall 238 of the frame 12. As will be explained below, the shield assembly and the lever handle (and, in turn, the overcenter mechanism) move in unison.

The power tool 20 can be any number of power tools, with one example shown in FIGS. 1 and 2 as a typical electric drill that is typically found in most homes and businesses, such as manufactured by Milwaukee corporation, Black+Decker corporation, Dewalt corporation, or any other drill manufacturing company. The power tool 20 can be either an AC corded powered drill or a DC battery powered drill shown. The power tool 20 includes a body 340, actuator 342 and chuck 344. The chuck 344 is configured to engage the axle 92 of the upper end can handling subassembly 42. The axle 92 is shown as being cylindrical, although other configurations are possible facilitate coupling, such as hexagonal or any other shape, or can even be a configuration that corresponds with how the power tool 20 typically couples to an attached apparatus, such as attached bits, blades, or even interchangeable attachments, such as Matrix attachments by Black+Decker corporation.

In the example shown, the axle 92 is sized such that the drill chuck 344 can be slid onto the axle 92 and tightened (with or without a tightening key) onto the axle 92 similarly as to how the drill chuck 344 can be tightened onto a drill bit or any other typical attached apparatuses that are attached to drills. As the can seaming apparatus 10 relies on the power tool 20 to rotate the upper chuck 48, a cost of purchasing the can seaming apparatus 10 can be reduced relative to a can seaming apparatus that utilizes a dedicated motor coupled thereto.

Figure 9:
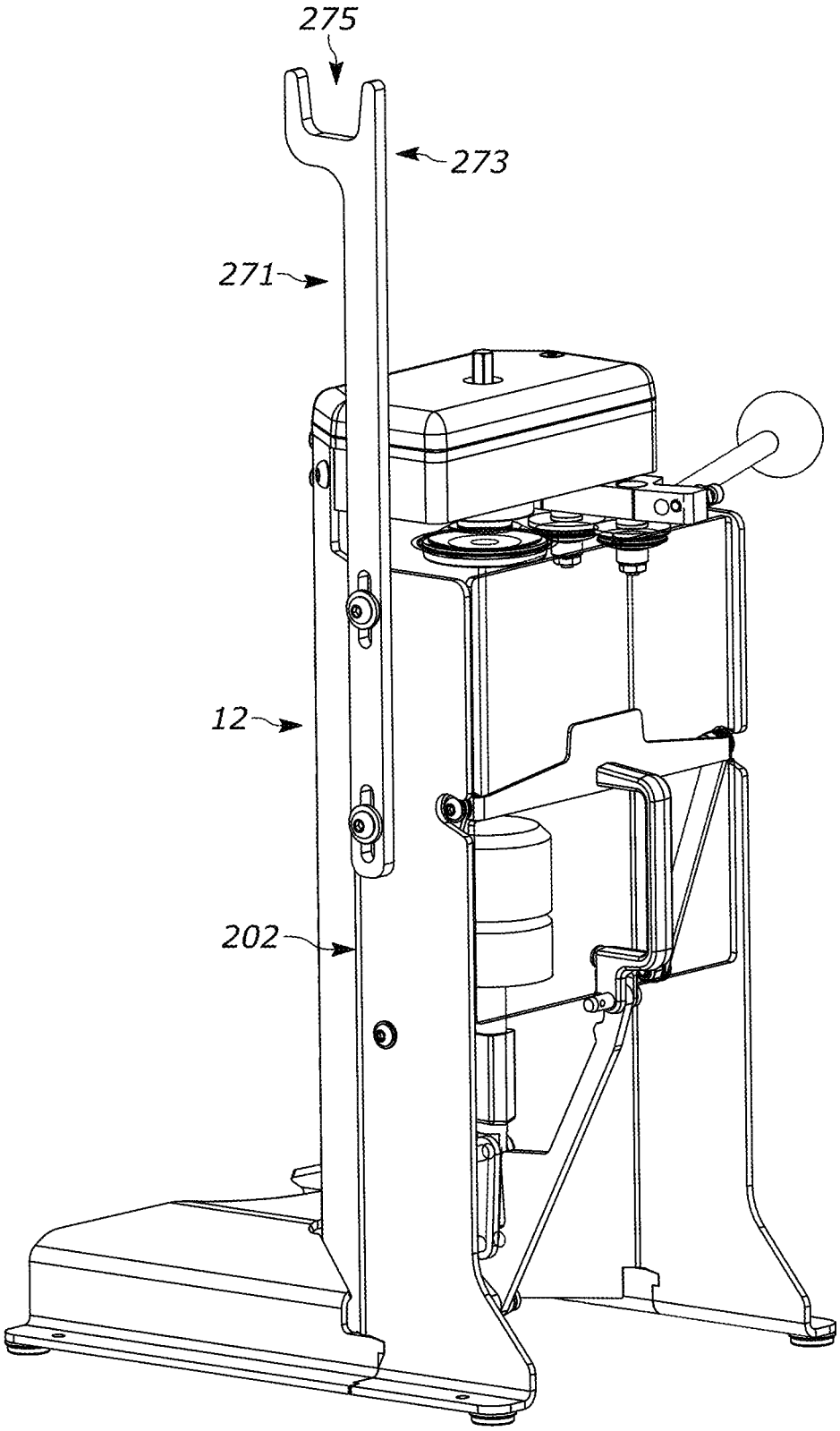
FIG. 9 illustrates a configuration of the can seaming apparatus of the present disclosure, showing, in particular the power tool mount coupled to the tower portion of the frame.

In the configuration shown in FIG. 9, a power tool mount 271 may be provided. The power tool mount 271 extends from the first side wall 230 of the frame 12 and terminates in fork 273 defining a slot 275. The power tool mount 271 is slidably adjustable at least in an up and down direction relative to the frame so as to be able to adjust to the user of different power tools. The power tool mount 271 retains the power tool in an operable position, and may be useful in situations wherein the power tool is remote operated, for example, or where additional support may be desired. In other configurations, the power tool mount may be omitted.

The seaming assembly 18 is shown in FIGS. 6, along with FIGS. 1, 7 and 8, as comprising roller frame 100, roller frame pivot axle 102, rotation actuator handle 104, first roller 106, second roller 108 and rotation limiting assembly 109. The roller frame 100 includes outer end 110 and inner end 112, with a pivot mount opening 114 positioned therebetween. The roller frame 100 further includes first roller mount and second roller mount (which each comprise openings configured to receive an axle). In the configuration shown, the pivot mount opening, the first roller mount and the second roller mount are all parallel and offset from each other (and also parallel to the rotation of the upper chuck 48). In the configuration shown, the first and second roller mounts are generally symmetrically associated with the pivot mount opening.

The roller frame pivot axle 102 extends between the pivot mount opening and the upper mounting plate 204 so that the two are rotatably pivotable relative to each other. In the configuration shown, the roller frame 100 and the roller frame pivot axle 102 are to the right hand side of the upper chuck 48, so that, as will be explained, the drill can be operated by the left hand of the user, while the handle can be operated by the right hand of the user. Of course, an opposite configuration can likewise be configured.

The rotation actuator handle 104 includes first end 120 and second end 122. The rotation actuator handle 104 generally comprises a substantially linear handle member, with a grasping member at the end thereof (in the configuration shown, a sphere).

The first roller 106 has a roller mount axle defining an axis of rotation 124. The first roller 106 includes outer periphery which includes a configuration that is structurally designed to form a desired seam portion of the can seam. The second roller 108 has a roller mount axle defining an axis of rotation 134. The second roller 108 includes outer periphery that includes a configuration that is structurally designed to form a desired seam portion of the can seam. It will be understood that the outer peripheries are often different in configuration, and are applied (or contacted with) the can to cooperatively, and sequentially form the can seam. The first and second rollers 106, 108 are on opposite sides of the roller frame pivot axle 102.

The rotation limiting assembly 109 comprises clockwise stop member 140 and counterclockwise stop member 142. The clockwise stop member 140 is positioned near the outer end of the roller frame, and, comprises a threaded fastener that extends into the roller fame generally perpendicular to the roller mount axles. Similarly, the counterclockwise stop member 142 is positioned near the inner end of the roller frame, and, comprises a threaded fastener that extends into the roller frame generally perpendicular to the roller mount axles (and generally parallel to and spaced apart from the clockwise stop member 140).

In the configuration shown, the roller frame 100 is structurally configured to rotate through approximately 150° to 220° of rotation, while it will be understood that variations are contemplated wherein the rotation is greater or less than 180°, for example, in other configurations, the rotation is preferably approximately 120°. Again, variations are contemplated which may be greater or less than 120°. It will be understood that these variations can be accomplished by moving the axis of rotation of the first and second rollers 106, 108 relative to the pivot axle 102, as well as optionally adjusting the rotation limiting assembly 109. Preferably, the rotation is on the order of between 60° and 200°, and more preferably between 110° and 185°, while not being limited thereto.

It will further be understood that other seaming assemblies are likewise contemplated for use. Such seaming assemblies include, but are not limited to the structures identified in the applications and issued patents that are set forth in the cross-reference to related applications, and which references are incorporated by reference in their entireties.

In operation, the user first is provided with the can seaming apparatus 10. The user next obtains a can 400 in an unassembled condition. The can 400 is positioned on the upper surface of the lower chuck 44. The configuration of the upper surface of the lower chuck 44, and including a chamfered outer rim, provides assistance and urges or otherwise directs the can 400 into the proper orientation. It will be understood that different chucks can be employed depending on the size or configuration of the can 400. It is contemplated that a set of lower chucks 44 may be provided or available to accommodate different configurations of the can 400, or spacers, such as spacer 51.

At the same time, the can 400 is inserted into a region of the can seaming apparatus 10 where the can 400 is seamed, and pushed or directed into contact with the inner edge 33 of the can forming bracket 27. It will be understood that when pressed against the inner edge 33, the can 400 is slightly out of alignment relative to the axis 53 (in the configuration shown).

Once positioned in a desired orientation, the shield assembly 16 can be moved into a position to cover the sealing cavity. More particularly, the user grasps the shield handle which is in a lower position (along with the lower chuck) and pivots the shield, the shield frame bracket and the shield handle relative to the frame 12 by way of the first and second side linkages 306, 308. As the arm 72 of the overcenter handle is coupled to the shield handle 304, the movement of the shield handle 304 also pivots the overcenter handle toward the upper position. Eventually, the overcenter handle reaches the upper position fully engaging the can with the upper and lower chucks. And, at the same time, the first and second side flanges 320, 322 of the shield frame bracket enter into the notch 234 of the first side wall 230 and notch 242 of the second side wall 238 and the shield side edges abuttingly position proximate the respective front edges of one of the first side wall and second side wall.

In greater detail as to the movement of the upper and lower chucks, as the arm 72 of the overcenter handle rotates, the lower chuck 44 is directed in an upward direction, along with the can 400. Eventually, the lid of the can 400 contacts the lower surface of the lower chuck 44. As the position of the inner edge 33 places the can 400 close enough to the axis 53, the upper chuck 48 pulls the can 400 away from the inner edge 33 and into alignment with axis 53. When in alignment, the sides of the can 400 are spaced apart from the inner edge 33, preferably, so that when rotating, the can 400 stays spaced apart from the inner edge 33 so it is not marred or destroyed. Such a configuration allows for simple positioning during attachment of the can 400 to ensure that the can 400 can easily be positioned in the desired orientation. At the same time, the can forming bracket does not mar or generally contact the can 400 while rotating. In other configurations, the bracket may remain in contact with the can 400 when aligned. In such configurations, the bracket may include rollers or other structures which limit marring and friction between the components.

At this time, the arm 72 reaches a position where the linkages are all generally axial, and further movement directs the lever portion of the overcenter handle 62 in an overcenter position, thereby locking the overcenter mechanism 59 is locked in position.

In this locked position, the can 400 is firmly sandwiched (or clamped) between the upper and lower chucks 48, 44 and substantially precluded from movement relative to either of the upper and lower chucks 48, 44.

Once the can 400 is clamped, and in an engaging configuration, or prior to attachment of the can, the user can attach the power tool 20 to the axle 92. In particular, the user can adjust the chuck 344 to receive the axle 92 and can tighten the chuck 344 so as to grasp the axle 92 with sufficient strength so that the two rotate in unison. In the configuration wherein a power tool mount 271 is employed, the power tool 20, and in particular, the handle portion of the body 340 thereof can be inserted into the slot 275 of the fork 273.

Advantageously, with the manner that the power tool has been attached to the axle 92, the force directed by the weight of the power tool is in a downward direction, thereby increasing stability of the can seaming apparatus, as is the force if the user is applying a downward force on the power tool. Furthermore, the position of the power tool allows for the user to operate the actuator 342 of the power tool with the left thumb while operating the remainder of the device (i.e., the handle of the seaming assembly) with the right hand. The foregoing may also comprise a mirror image wherein the drill is operated by the right thumb and the left hand operates the seaming assembly.

It will be understood that in other configurations, the drill may be remotely actuated and mounted to the frame. In still other configurations, the power tool may include various chucks that move the power tool away from the frame, and/or that provide an angled chuck wherein the axle of the drill and the axle of the chuck are not colinear. Other variations are likewise contemplated.

Next, the can 400 is spun on its central axis 53 along with the upper and lower chucks 48, 44. To spin the can 400, the power tool 20 is actuated (preferably with the left thumb of the user). The power of the power tool 17 rotates the power tool coupler 16, which rotates the can 400. The can 400 rotates at a speed of the power tool 20. It will be understood that a number of different configurations are contemplated, including a constant speed for the power tool 20 and a variable speed for the power tool 20, depending upon a design of the power tool 20 by a manufacturer thereof.

Once the can 400 reaches sufficient speed, the can top is crimped to the can 400 to form the double can seal. This is achieved by first directing the first roller 106 into contact with the can 400 and the can top, to initiate the formation of the double can seal. Next, the second roller 108 is directed into contact with the can 400 and the can top to finish the double can seal. In more detail, the user first grasps the rotation actuator handle 104 of the seam forming assembly 18 and rotates the lever thereof about the roller frame pivot axle 102, in a first, clockwise direction. Eventually, the first roller 106 comes into contact with the can 400 and initiates the crimping of the can top of the can 400 with a can lid. So that the first 106 roller does not apply too great a force on the can 400, the counterclockwise stop member 142 eventually contacts the clockwise stop member 140 precluding further rotation.

Once the first crimping deformation is applied by the first roller 106, the rotation actuator handle 104 is rotated in the opposite direction to direct the first roller 106 away from the can 400. The rotation of the rotation actuator handle 104 continues until the second roller 108 contacts the can 400 and the top of the can 400. As the second roller 108 is further rotated, the second roller 108 applies the crimping deformation to complete the double can seal on the can 400. The rotation of the second roller 108 is precluded when the counterclockwise stop member 142 contacts the lower limit surface 37.

Once the second roller 108 has applied the final crimping step, the second roller 108 can be rotated about the roller frame pivot axle 102 to move the second roller 108 away from the can 400. The rotation actuator handle 104 can be moved so that the roller frame 100 is in a position where neither the first roller 106 or the second roller 108 are in contact with the can 400. At such time, the can 400 is fully formed and sealed.

It will be understood that the spacing of the first and second rollers 106, 108 relative to the roller frame pivot axle 102 and the upper chuck 48 is such that as rotated, the first and second rollers 106, 108 contact the can 400 at tangential points so as to minimize the force necessary to be exerted onto the can 400, and also to limit undesired over-deformation of the can 400. Of course, the first and second rollers 106, 108 can be positioned relative to the roller frame pivot axle 102 so as to achieve the desired forces onto the can 400 and the desired rotation of the roller frame 100 relative to the upper mounting plate 28.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A can seaming apparatus comprising:

a power tool having a body, an actuator and a chuck;

a frame with a bottom end and a top end, an upper mounting plate attached to the frame proximate the top end of the frame, and a lower mounting member attached to the frame proximate the bottom end of the frame;

a can handling assembly including:

an upper chuck fixed to an axle that extends through the upper mounting plate, and is rotatably coupled to the upper mounting plate, the axle extending beyond the upper mounting plate and structurally configured to be free from obstruction sufficient to allow for an operable attachment of the chuck of the power tool, and wherein the chuck is attached to the axle extending through the upper mounting plate, whereupon rotation of the chuck rotates the axle;

a lower chuck having an axle extending therefrom, the axle slidably mountable to the lower mounting member, with an overcenter mechanism including a handle that is movable relative to the frame to direct the lower chuck between a lower position and an upper position, wherein in the upper position, the lower chuck is directed into position relative to the upper chuck so as to releasably retain a can therebetween; and a can seaming assembly having a roller frame pivotably coupled to the upper mounting plate, the roller frame having a first roller and a second roller rotatably mounted to the roller frame, with a handle extending outwardly from the roller frame so as to structurally facilitate the pivoting of the roller frame about the upper mounting plate so as to direct one of the rollers toward the upper chuck while directing the other of the rollers away from the upper chuck.

2. The can seaming apparatus of claim 1, further comprising:

a power tool mount coupled to the frame, the power tool mount having a fork defining a slot, with the body of the power tool being releasably positionable within the slot when the chuck is attached to the axle.

3. The can seaming apparatus of claim 1 wherein the actuator of the power tool is positioned to a first side of the frame with the handle of the can seaming assembly being positioned on a second side of the frame opposite the first side of the frame, to allow for a user to operate each with one hand.

4. A can seaming apparatus comprising:

a frame with a bottom end and a top end, an upper mounting plate attached to the frame proximate the top end of the frame, and a lower mounting member attached to the frame proximate the bottom end of the frame;

a can handling assembly including:

an upper chuck fixed to an axle that extends through the upper mounting plate, and is rotatably coupled to the upper mounting plate, the axle extending beyond the upper mounting plate and structurally configured to be free from obstruction sufficient to allow for an operable attachment of a chuck of a power tool;

a lower chuck having an axle extending therefrom, the axle slidably mountable to the lower mounting member, with an overcenter mechanism including a handle that is movable relative to the frame to direct the lower chuck between a lower position and an upper position, wherein in the upper position, the lower chuck is directed into position relative to the upper chuck so as to releasably retain a can therebetween; and a can seaming assembly having a roller frame pivotably coupled to the upper mounting plate, the roller frame having a first roller and a second roller rotatably mounted to the roller frame, with a handle extending outwardly from the roller frame so as to structurally facilitate the pivoting of the roller frame about the upper mounting plate so as to direct one of the rollers toward the upper chuck while directing the other of the rollers away from the upper chuck, wherein the frame comprises:

a tower portion having a back wall, a first side wall on one side of the back wall, a second side wall a side of the back wall opposite the first side wall, a first side wing extending between the back wall and the first side wall, and being oblique to each, and a second side wing extending between the back wall and the second side wall, and being oblique to each;

a base portion having a central region, a first side wall on one side of the central region and a second side wall on a side of the central region opposite the first side wall, the first side wall including a front flange that is insertable through a lower slot of the first side wing of the tower portion and the second side wall including a front flange that is insertable through a lower slot of the second side wing of the tower portion.

5. The can seaming apparatus of claim 4 wherein the central region of the base portion is perpendicular to the back wall of the tower portion.

6. The can seaming apparatus of claim 3 further comprising a shield assembly including:

a shield having a first side edge, a second side edge, a lower edge and an upper edge, the shield configured so as to extend between the first side wall and the second side wall;

a shield frame bracket having a first side flange proximate the first side edge and a second side flange proximate the second side edge;

a shield handle extending from a front of the shield;

a first side linkage having a first end pivotably coupled to the first side wall and a second end pivotably coupled to the first side flange;

a second side linkage having a first end pivotably coupled to the second side wall and a second end pivotably coupled to the second side flange;

the handle of the overcenter mechanism is attached to at least one of the handle and the shield proximate the lower edge of the shield, wherein the pivoting the shield by the handle relative to the first side linkage and the second side linkage moves the lower chuck between a lower position and an upper position.

7. The can seaming apparatus of claim 6 wherein the first side wall includes a notch along a front edge thereof and the second side wall includes a notch along a front edge thereof, with the first side flange of the shield frame bracket engaging with the notch of the first side wall when the lower chuck is in the upper position, and with the second side flange of the shield frame bracket engaging with the notch of the second side wall when the lower chuck is in the upper position.

8. The can seaming apparatus of claim 4 wherein the first side wall of the tower portion includes a first foot, the second side wall includes a second foot, the first side wall of the base portion includes a third foot, and the second side wall of the base portion includes a fourth foot, the first, second, third and fourth foot forming a stable base upon which the can seaming apparatus is placeable on an outside surface.

9. The can seaming apparatus of claim 4 wherein the tower portion is formed from a single planar sheet, and wherein the base portion is formed from a single planar sheet.

10. A can seaming apparatus comprising:

a frame with a bottom end and a top end, an upper mounting plate attached to the frame proximate the top end of the frame, and a lower mounting member attached to the frame proximate the bottom end of the frame;

a can handling assembly including:

an upper chuck fixed to an axle that extends through the upper mounting plate, and is rotatably coupled to the upper mounting plate, the axle extending beyond the upper mounting plate and structurally configured to be free from obstruction sufficient to allow for an operable attachment of a chuck of a power tool;

a lower chuck having an axle extending therefrom, the axle slidably mountable to the lower mounting member, with an overcenter mechanism including a handle that is movable relative to the frame to direct the lower chuck between a lower position and an upper position, wherein in the upper position, the lower chuck is directed into position relative to the upper chuck so as to releasably retain a can therebetween;

a can seaming assembly having a roller frame pivotably coupled to the upper mounting plate, the roller frame having a first roller and a second roller rotatably mounted to the roller frame, with a handle extending outwardly from the roller frame so as to structurally facilitate the pivoting of the roller frame about the upper mounting plate so as to direct one of the rollers toward the upper chuck while directing the other of the rollers away from the upper chuck; and an upper cover member positioned over the upper mounting plate, with the axle extending through the upper cover member.

11. The can seaming apparatus of claim 10, further comprising:

a power tool having a body, an actuator and a chuck;

wherein the chuck is attached to the axle extending through the upper mounting plate, whereupon rotation of the chuck rotates the axle.

12. The can seaming apparatus of claim 11, further comprising:

a power tool mount coupled to the frame, the power tool mount having a fork defining a slot, with the body of the power tool being releasably positionable within the slot when the chuck is attached to the axle.

13. The can seaming apparatus of claim 11 wherein the actuator of the power tool is positioned to a first side of the frame with the handle of the can seaming assembly being positioned on a second side of the frame opposite the first side of the frame, to allow for a user to operate each with one hand.

14. The can seaming apparatus of claim 10 wherein the frame comprises:

a tower portion having a back wall, a first side wall on one side of the back wall, a second side wall a side of the back wall opposite the first side wall, a first side wing extending between the back wall and the first side wall, and being oblique to each, and a second side wing extending between the back wall and the second side wall, and being oblique to each;

a base portion having a central region, a first side wall on one side of the central region and a second side wall on a side of the central region opposite the first side wall, the first side wall including a front flange that is insertable through a lower slot of the first side wing of the tower portion and the second side wall including a front flange that is insertable through a lower slot of the second side wing of the tower portion.

15. The can seaming apparatus of claim 14 wherein the first side wall of the tower portion includes a first foot, the second side wall includes a second foot, the first side wall of the base portion includes a third foot, and the second side wall of the base portion includes a fourth foot, the first, second, third and fourth foot forming a stable base upon which the can seaming apparatus is placeable on an outside surface.

16. A combination can seaming apparatus and power tool, wherein the can seaming apparatus further comprises:

a frame with a bottom end and a top end, an upper mounting plate attached to the frame proximate the top end of the frame, and a lower mounting member attached to the frame proximate the bottom end of the frame;

a can handling assembly including:

an upper chuck fixed to an axle that extends through the upper mounting plate, and is rotatably coupled to the upper mounting plate, the axle extending beyond the upper mounting plate and structurally configured to be free from obstruction sufficient to allow a for the operable attachment of a chuck of the power tool;

a lower chuck having an axle extending therefrom, the axle slidably mountable to the lower mounting member, movable toward and away from the upper chuck; and a can seaming assembly having a first roller and a second roller rotatably mounted to at least one roller frame, the at least one roller frame configured to pivot about the frame so as to selectively direct the first roller and the second roller toward the upper chuck and away from the upper chuck, the power tool including a body, an actuator and a chuck, the chuck releasably coupled to the axle.

17. The combination of claim 16 wherein the frame further includes a power tool mount extending from the frame, with the power tool being releasably mountable to the power tool mount.

18. A method of sealing a can comprising the steps of:

providing a can seaming apparatus, the can seaming assembly comprising:

a frame with a bottom end and a top end, an upper mounting plate attached to the frame proximate the top end of the frame, and a lower mounting member attached to the frame proximate the bottom end of the frame;

a can handling assembly including:

an upper chuck fixed to an axle that extends through the upper mounting plate, and is rotatably coupled to the upper mounting plate, the axle extending beyond the upper mounting plate and structurally configured to be free from obstruction sufficient to allow a for the operable attachment of a chuck of a power tool;

a lower chuck having an axle extending therefrom, the axle slidably mountable to the lower mounting member, movable toward and away from the upper chuck; and a can seaming assembly having a first roller and a second roller rotatably mounted to at least one roller frame, the at least one roller frame configured to pivot about the frame so as to selectively direct the first roller and the second roller toward the upper chuck and away from the upper chuck, providing a power tool, the power tool including a body, an actuator and the chuck;

attaching the chuck to the axle;

retaining a can with a top between the upper chuck and the lower chuck;

actuating the drill;

engaging the can with the top by the first roller; and engaging the can with the top by a second roller.

19. The method of sealing a can of claim 18 further comprising the step of:

placing a shield assembly over the can during the steps of actuating the drill, engaging the can with the top by the first roller and engaging the can with the top by a second roller.

* * * * *